United States Patent [19]

Stolkin et al.

[11] 3,964,374

[45]* June 22, 1976

[54] CARTON FOLDING AND GLUEING DEVICE

[75] Inventors: Walter J. Stolkin, Chicago; William A. Riley, Woodridge, both of Ill.; Henry Sejda, Munster, Ind.

[73] Assignee: Stolmar Corporation, Chicago, Ill.

[ * ] Notice: The portion of the term of this patent subsequent to May 20, 1992, has been disclaimed.

[22] Filed: Sept. 12, 1974

[21] Appl. No.: 505,451

[52] U.S. Cl. ..... 93/36 MM; 93/49 R; 93/52

[51] Int. Cl.[2] ..... B31B 1/36; B31B 1/52; B31B 1/62

[58] Field of Search ..... 93/49 R, 52, 45, 48, 93/84 R, 84 TW, 36 R, 36 MM

[56] References Cited

UNITED STATES PATENTS

| | | | |
|---|---|---|---|
| 2,775,923 | 1/1957 | Ellinger | 93/49 R |
| 2,857,827 | 10/1958 | Labombarde | 93/49 R |
| 3,371,585 | 3/1968 | Moser et al. | 93/52 |
| 3,620,139 | 11/1971 | Kulwicki | 93/52 X |
| 3,884,130 | 5/1975 | Stolkin et al. | 93/49 R |

*Primary Examiner*—James F. Coan
*Attorney, Agent, or Firm*—McDougall, Hersh & Scott

[57] ABSTRACT

An apparatus for producing a carton in a folded condition for storage and handling and whereby the carton can then be unfolded for use. The apparatus is designed for handling different types of blanks which, generally speaking, include a plurality of panels comprising side, top and bottom panels of the carton. The bottom panels are provided with flaps, and a first folding structure is provided for folding the bottom panels over onto adjacent side panels. Simultaneously, second folding means serve to fold flaps over onto the associated bottom panels, and adhesive applying means serve to locate adhesive on the blanks in selected positions.

24 Claims, 12 Drawing Figures

CARTON FOLDING AND GLUEING DEVICE

This application is directed to folding devices compatible with the invention disclosed in co-pending application Ser. No. 454,256, filed Mar. 25, 1974, now U.S. Pat. No. 3,884,130, assigned to the present assignee, entitled "Apparatus for Producing Cartons".

This invention is directed to subassemblies suitable for incorporation in apparatus designed for producing cartons. The invention is particularly applicable to the production of cartons known in the trade as regular slotted containers, center special slotted containers, overlap slotted containers, center special overlap slotted containers, full flap slotted containers, center special full flap slotted containers, and regular half slotted containers.

Particular carton constructions are available which include means for automatically setting up the carton when it is unfolded, such constructions including a combination of interconnected bottom panels. In use, the carton are adapted to be unfolded with the various panels then automatically assuming the proper configuration for use. The carton designs are extremely sturdy in addition to being extremely easy to handle.

In the manufacture of cartons of the type referred to, it is extremely important to provide efficient mechanisms for producing the cartons. Thus, the cartons are ordinarily produced in very great numbers so that the use of high speed automated production apparatus becomes a necessity. Furthermore, the marketing of the cartons comprises a highly competitive business so that it is necessary to minimize the expense of purchasing and operating the manufacturing equipment.

It is a general object of this invention to provide an improved apparatus for use in the production of carbon constructions.

It is a further object of this invention to provide an apparatus which is particularly suitable for the production of cartons which will automatically set up.

It is a still further object of this invention to provide an apparatus of the type described which can be produced at relatively low cost, which can be readily incorporated in existing equipment, thereby minimizing installation costs, and which can be operated at relatively low cost.

These and other objects of this invention will appear hereinafter, and for purposes of illustration, but not of limitation, specific embodiments of the invention are shown in the accompanying drawings in which.

DETAILED DESCRIPTION

This invention is generally directed to an apparatus for producing a folded carton whereby the carton can be efficiently stored, shipped, and otherwise handled and whereby the carton can be readily unfolded for use. The invention is particularly well suited for making cartons of the general type wherein the carton is ready for use after only a simple unfolding operation.

The invention is particularly concerned with a folding structure and associated elements designed to handle the particular blank necessary for providing the carton arrangement described. The folding structure includes a first folding means including a flipper assembly which serves to fold the carton bottom panels over onto the adjacent carton side panels. A second folding device including a plow assembly is provided for engaging flaps and these flaps are thereby folded over onto the bottom panel carrying the flaps. Adhesive is selectively applied to the blank by a glueing unit, and third folding means then fold the ends of the blank over intermediate portions of the blank. The flaps which have been previously folded over are secured by means of the adhesive to adjacent bottom panels. Additional means, such as adhesive, serve to secure the ends of the blank together when these ends are brought into adjoining relationship by the third folding means.

Figure 1:
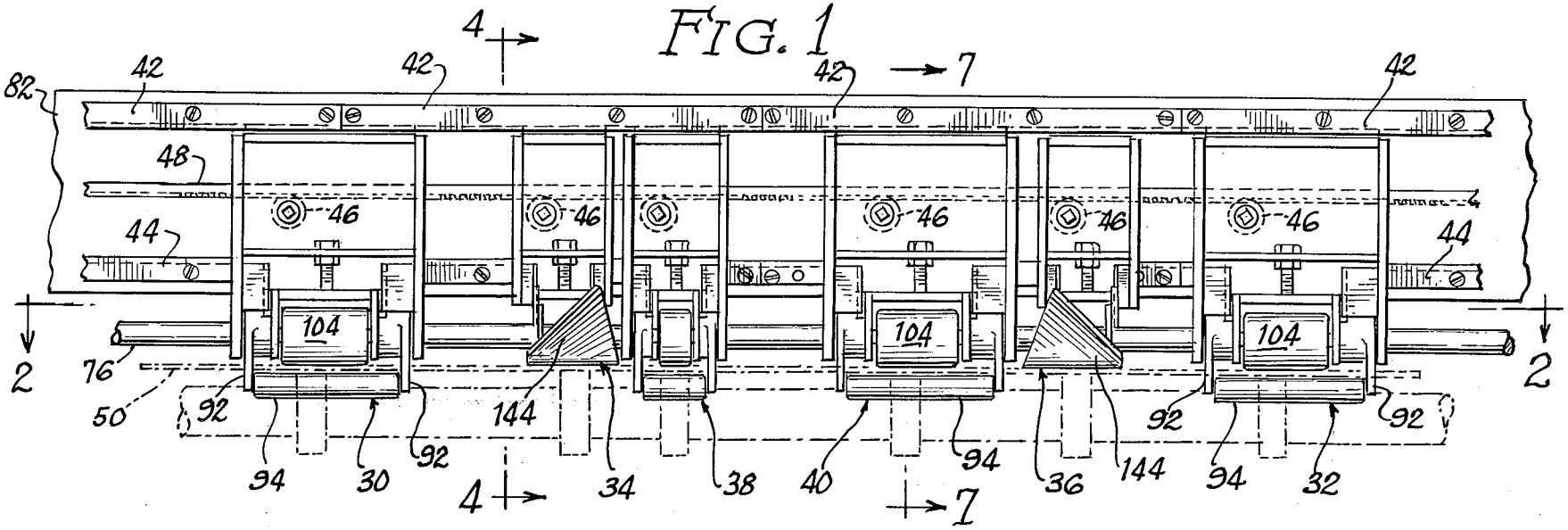
FIG. 1 is an elevation view of the folding and glueing device as contemplated by this invention.

FIG. 1 of the drawings of related application Ser. No. 454,256 and the corresponding description incorporated hereby illustrate and describe an apparatus to which the present invention has application. This apparatus may include basically standard operating elements in the forward section such as standard scoring and cutting means. It is well within the skill of the art to provide mechanisms which will provide a flat blank of corrugated material or the like. Any suitable conveyer mechanism may be utilized for moving this blank and successive blanks over a supporting bed. The blanks will generally be transported from a rotary die cutting section of the system.

Of particular concern in the present disclosure is the folding apparatus illustrated in FIG. 1 of the said related application. This apparatus comprises a pair of upstanding support plates and at least two shafts rotatably supported by these plates. These shafts carry conveying rolls which are adapted to engage a carbon blank. A third shaft supported by the support plates carries folding members comprising flipper assemblies thereon. A plow assembly is also utilized. The present disclosure is concerned with particular flipper and plow constructions, which constructions are adapted to be utilized in the device illustrated in FIG. 1 of the above referenced application. Further, the present invention includes means for applying adhesive to the carton blanks.

Figure 2:
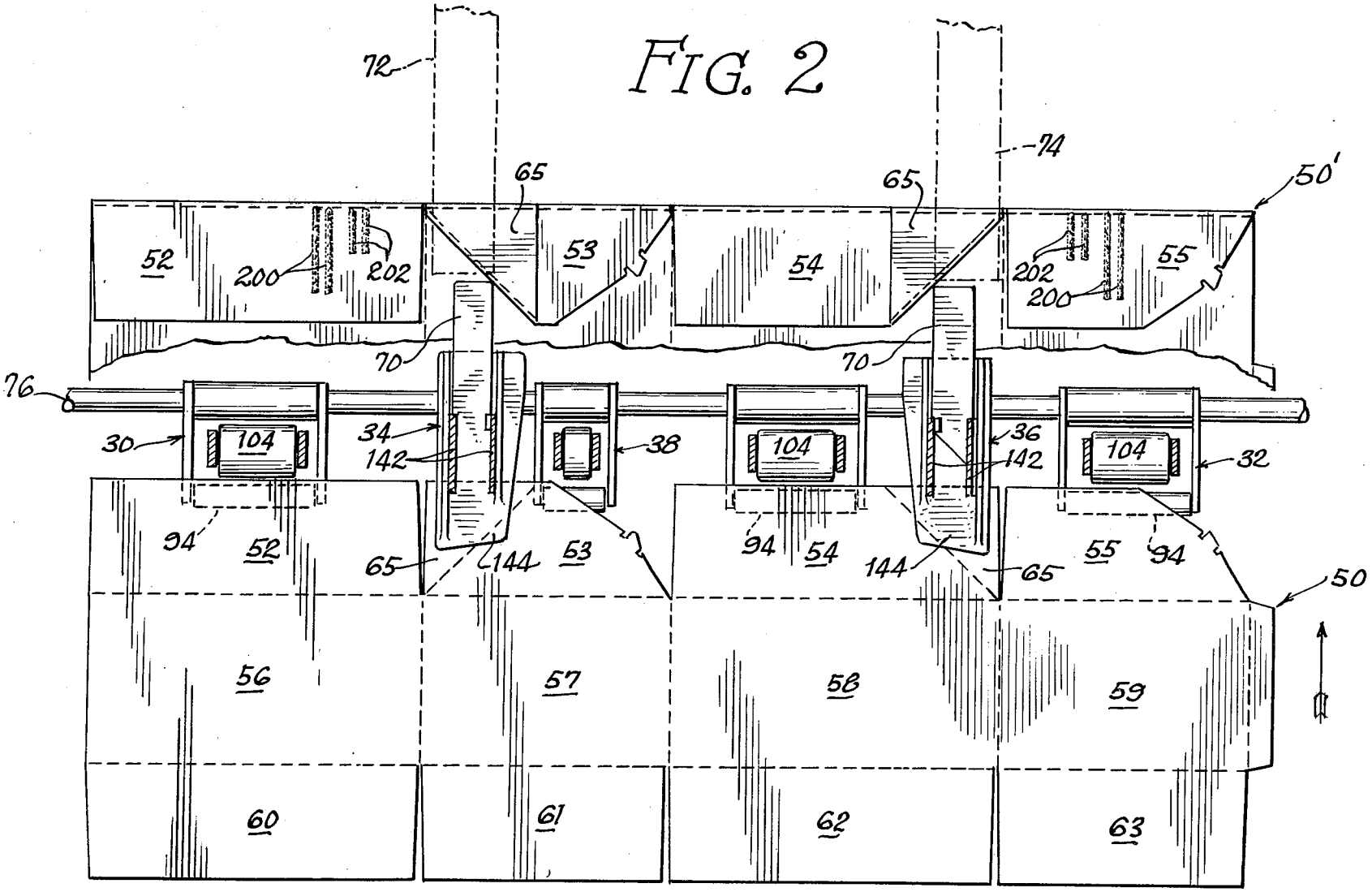
FIG. 2 is a plan view of the device taken along the lines 2—2 of FIG. 1.

Referring now to FIGS. 1 and 2 of the present application, there is illustrated a plurality of plow and flipper assemblies constructed according to the present invention. These assemblies are mounted to a frame in the manner illustrated in FIG. 1 of the above referenced related application. The particular mounting structure will be described subsequently in this application in connection with FIGS. 3, 4 and 7. As illustrated in FIG. 1, a pair of large flipper assemblies 30, 32 are located at either end of a folding unit. Located intermediate of the large flipper assemblies are a pair of plow assemblies 34, 36 and a small flipper assembly 38. The particular arrangement number and types of assemblies provided on the folding frame will depend upon the particular type of box construction utilized. It will thus be apparent that any combination of flippers and plows can be provided as necessary for a particular box construction.

The flipper assemblies are mounted to the machine frame on a pair of clamp bars including an upper clamp bar 42 and a lower clamp bar 44. The flipper and plow assemblies are laterally movable so that they may be positioned as desired along the entire width of the clamp bars. This lateral movement is accomplished by utilizing a hand tool to engage a tool receiving portion of a gear 46 provided on each of the plow and flipper assemblies. Rotation of the tool receiving portion of the gears 46 causes the gears to rotate against a fixed rack 48. The gear teeth cooperate with the rack to provide accurate lateral movement for a given amount of rotation of the gear 46. In this manner, accurate lateral positioning of the assemblies is easily accomplished.

As best seen in the plan view of FIG. 2, the plow and flipper assemblies are positioned to receive a cardboard blank 50. The blank 50 typically includes a plurality of bottom panels 52–55, associated side panels 56–59, and top panels 60–63. The blank is fed into the folding device bottom panels first. As described more fully in the prior referenced application, the folding device, including the flippers and plows, is effective for folding the bottom planes 52–55 upward from the plane of the paper and onto the side panels 56–59 respectively. Simultaneously, the two plow assemblies 34, 36 are effective for hindering or preventing a corner flap 65 on panels 53 and 54 from being folded over onto the side flaps. The action of the plows is effective for forming a triangular flap folded backwardly on top of the bottom panels 53 and 54. As described in the prior application, this panel is subsequently adhered to the panels 52 and 55 to form an automatic setup carton.

After the triangular flaps have been formed by the plows 34, 36, this portion is held in its double folded condition by an extension plate 70 extending rearwardly from the plow. This plate holds the triangular flap 65 in position until the carton reaches the belt conveyers 72, 74 which carry the carton to further processing stations.

As indicated by the blank 50' in FIG. 2 before the bottom panels are released from the extension plates, glue is disposed upon the corresponding portions of flaps 52 and 55 where the triangular portions 65 will mate. The glue applied is typically hot melt glue having a short curing time.

The flipper assemblies are mounted to a shaft 76 running laterally the entire width of the folding machine. Rotation of this shaft is effective to produce reciprocating motion of the flipper assemblies in synchronization with the receipt of cartons 50. Thus, for each carton received, the flippers move from a first position beneath the level of the incoming blank to a second position above the blank level whereby the flaps 52–55 are caused to be folded to the position indicated on blank 50'. The plow assemblies 34, 36 are not mounted to the shaft 76 but to a frame assembly as illustrated in the subsequent figures and remain stationary throughout the operation.

Figure 7:
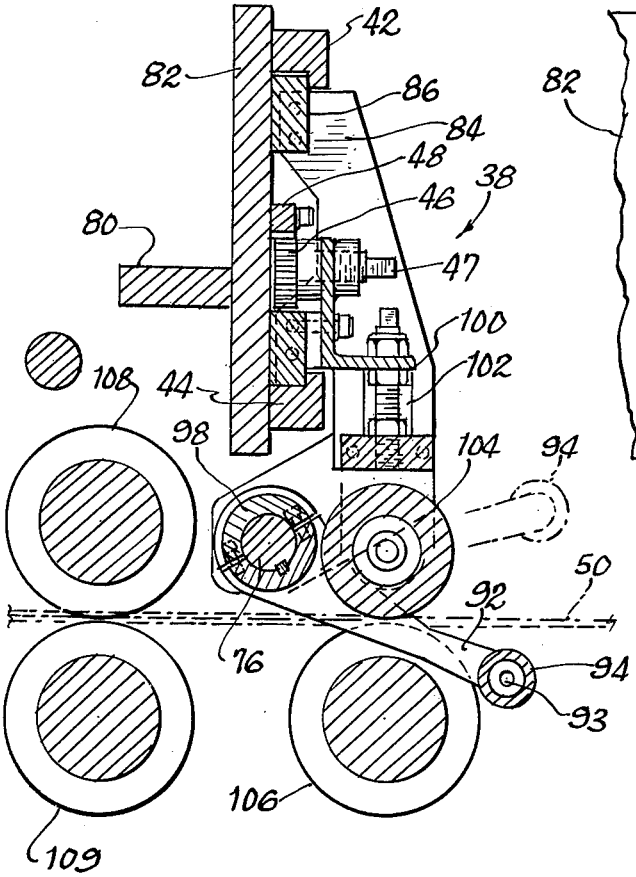
FIG. 7 is a view of the flipper according to the first embodiment taken along the lines 7—7 of FIG. 1.
Figure 8:
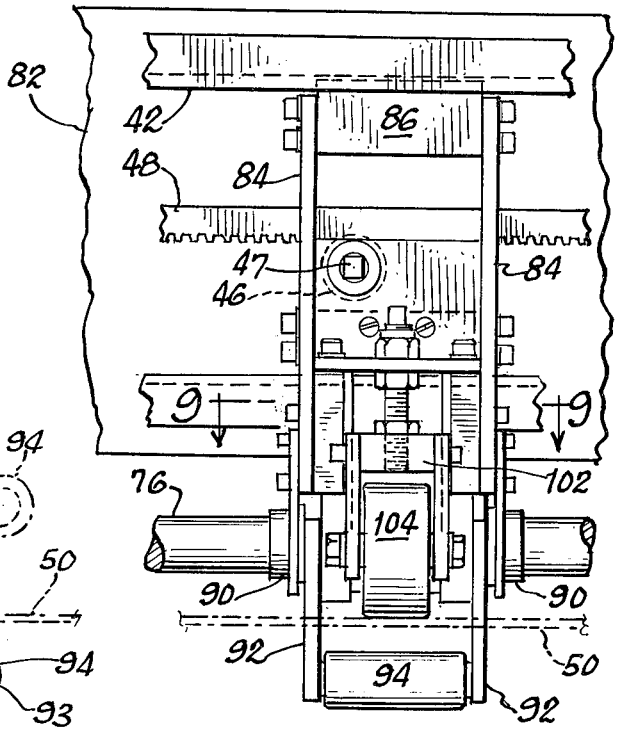
FIG. 8 is an elevational view of the flipper construction shown in FIG. 7.
Figure 9:
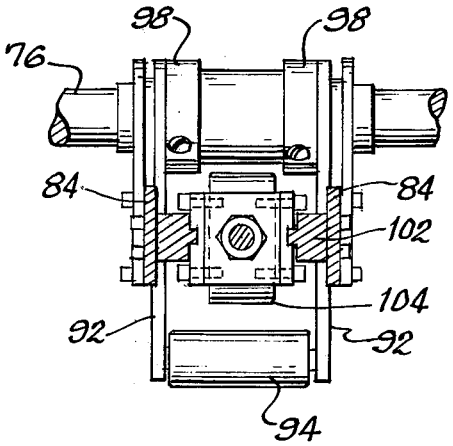
FIG. 9 is a plan view of the FIG. 7 construction.

Referring now to FIGS. 7–9, the detail of the small flippers 38 and 40 are disclosed. The folding device has a stiffening bar 80 running the entire width of the device to which is affixed a back plate 82. The back plate 82 similarly runs the width of the device and serves as the main mounting structure to which the flipper and plow assemblies are attached. Bolted or welded to the back plate 82 are the upper and lower clamp bars 42 and 44. The clamp bars form a pair of channels which permit lateral movement of the assemblies mounted therein. The small flipper assembly 38 is mounted to the clamp bars by a pair of mounting plates 84 positioned on either side of the flipper. The plates are attached to sliding members 86 and 88 which are adapted to move laterally in the channels formed by the clamp bars 42 and 44. The lower section of the plates 84 have openings therein for receiving the flipper shaft 76 therethrough, said shaft passing through a sleeve 90 which constitutes a low friction bearing.

The flipper includes a pair of arms 92 located on either side of a roller 94 axially mounted to the arms 92 by a pin 93 passing therethrough. As indicated best in FIG. 9, the arms of the flipper are secured to the shaft 76 by mating with a cap portion 98 which constitutes a hollow half cylinder adapted to fit over the flipper shaft. A half cylinder 98 is secured to both flipper arms 92 which terminate in a cooperating hollow half cylindrical section as by bolting or screwing. Thus, the half cylinders 98 are placed over the flipper shaft and secured to the arms 92 to form a mating clamp on the shaft 76. In this manner the flipper assembly is secured to the flipper shaft for rotation therewith.

As indicated in phantom in FIG. 7, the flipper roller 94 is moved by the shaft 76 between the lowered position indicated by the solid lines and a raised position indicated by dashed lines, whereby a bottom carton flap is folded over onto a side flap.

Attached to the mounting plate 84 is the gear assembly 46 for laterally positioning the flipper assembly. A tool engaging portion 47 of the gear extends forwardly of the plate for easy engagement by a tool. The rack 48 engages the teeth of the gear 46 to lock the assembly in the position desired. In order to move the assembly laterally, a tool is applied to the tool engaging portion 47 for rotation of the gear 46 to a new desired location along the length of the rack 48.

Also attached to the mounting plate 84 by means of an L-bracket 100 is an adjustable mounting 102 for a feed or compression roller 104. The compression roller 104 may be formed of a metal or rubber collar on a shaft which cooperates with a lower collar and shaft 106 to convey a cardboard carton passing therebetween. A rearwardly disposed pair of rollers 108 and 109 are provided to continue feeding the cartons through the folding station. In order to maintain the proper compression on the cartons as they enter, the roller 104 is adjusted by mounting bolt 102 and then securing the bolt in place with a nut.

Figure 3:
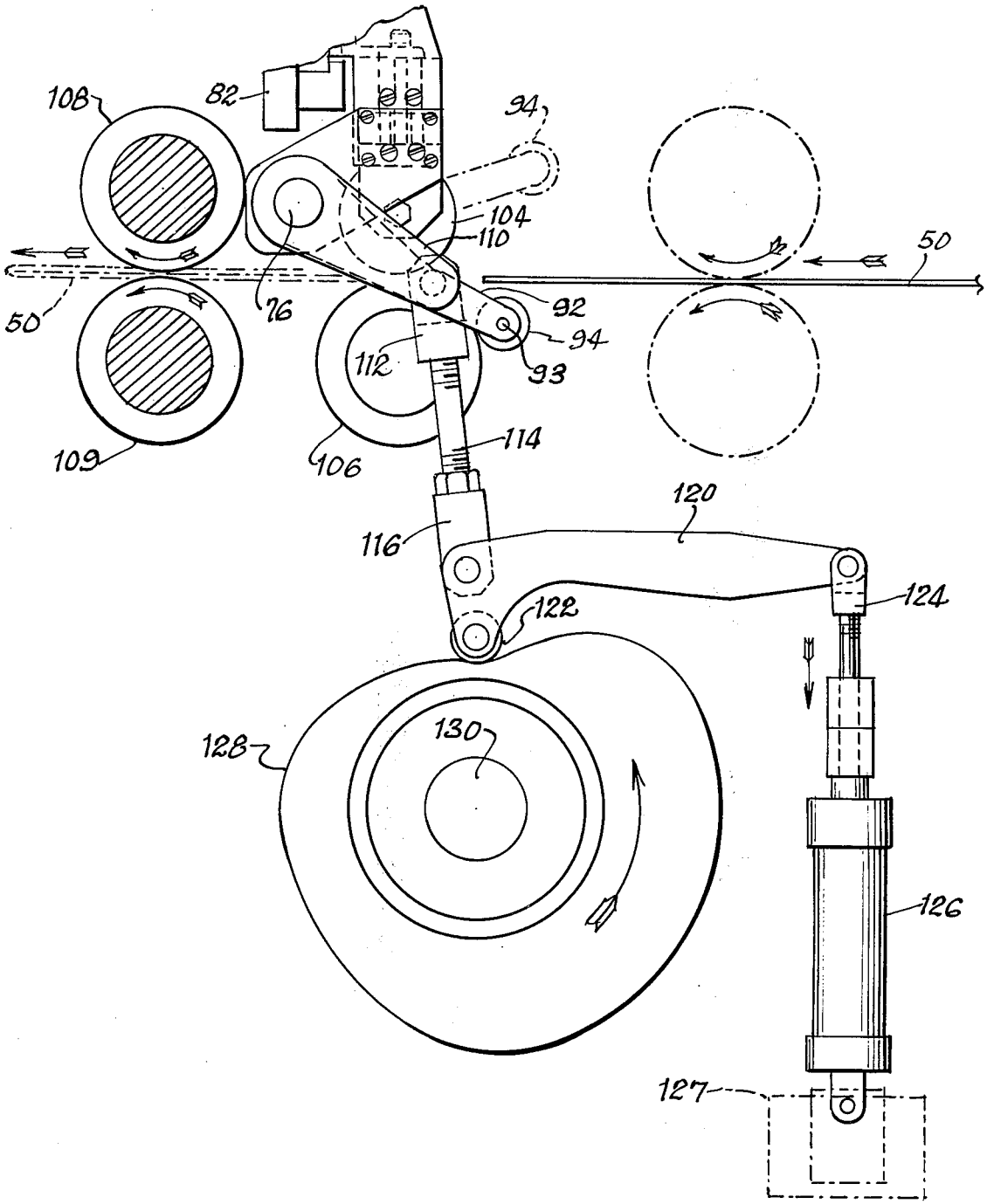
FIG. 3 is an end elevation of the device of FIG. 1 illustrating a flipper assembly according to a first construction including the camming mechanism utilized to operate it.

Referring now to FIG. 3, the mechanical linkage for reciprocally moving the flippers betwen their raised and lowered position is illustrated. As mentioned, all of the flippers are secured to the shaft 76 which runs the width of the folding device. Attached on both ends of the shaft 76, preferably outside of the bearing supports for the shaft, is a pinion plate 110. The pinion plate 110 is formed in a shape generally resembling that of the flipper arms 92. For purposes of contrast in FIG. 3 the flipper arms 92 are indicated by dashed lines inside of the pinion plate 110. The pinion plates are affixed to the shaft 76 such that rotation of the pinion plate causes rotation of the shaft and in turn the desired flipper movement.

Rotatably attached to one of the pinion plates at the end remote from the shaft 76 is a clevice 112. This clevice is adapted to receive a rod 114, the other end of which passes into a rocker arm clevice 116. The depth to which the rod 114 is threadingly engaged into the two clevices 112 and 116 permits adjustment of the vertical distance which the pinion plate is moved. The lower clevice 116 is rotatably attached to a rocker arm 120 having a cam follower portion 122 thereon. The end of the rocker arm remote from the clevice is rotatably attached to a piston 124 which is vertically reciprocated by a double acting air cylinder 126 attached to a mounting assembly 127 which may be on the floor or part of the machine structure.

A cam 128 is mounted for rotation on a shaft 130. When the piston 124 of the air cylinder 126 is retracted, the rocker arm 120 causes the cam follower 122 to remain in contact with the periphery of the cam 128. Thus, as the shaft 130 rotates, the cam follower 122 will trace the contour of the cam, which action causes the reciprocating movement of the pinion plate 110. Reciprocating movement of the pinion plate is effective for causing reciprocal rotation of the shaft 76 and of the flippers attached thereto.

As will be appreciated, the device according to the present invention is utilized for folding the bottom panels of cartons which are adapted for automatic setup. It is desirable to provide this device as part of a larger system capable of manufacturing boxes other than the automatic setup type. When boxes of the latter type are being assembled, it is desirable to inactivate the flippers and maintain them in a position so as to avoid interference with the carton blanks passing through the mechanism. This is accomplished by use of the two-way cylinder 126. When it is desired to render the flippers 92 inoperative, the piston is caused to extend from the cylinder thereby raising the rocker arm and cam follower 122 above the level of the rotating cam. Thus, the flippers remain in a raised position out of the path of carton blanks passing through the folding device. Thus it is unnecessary to disassemble the device or remove it from the assembly line when boxes which do not require its use are being manufactured. When it is again desired to utilize the flippers for manufacturing automatic setup type boxes, the two-way cylinder is actuated to pull the cam follower down onto the cam shaft to maintain it in intimate contact with the cam, thereby reciprocally to operate the flippers.

Figure 4:
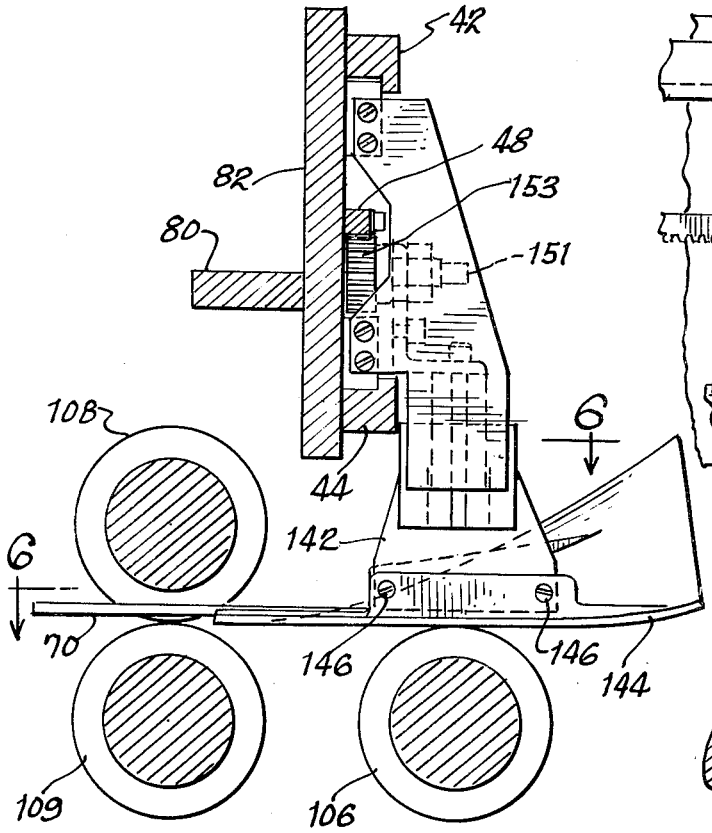
FIG. 4 is an end elevation of the plow assembly taken along the lines 4—4 of FIG. 1.
Figure 5:
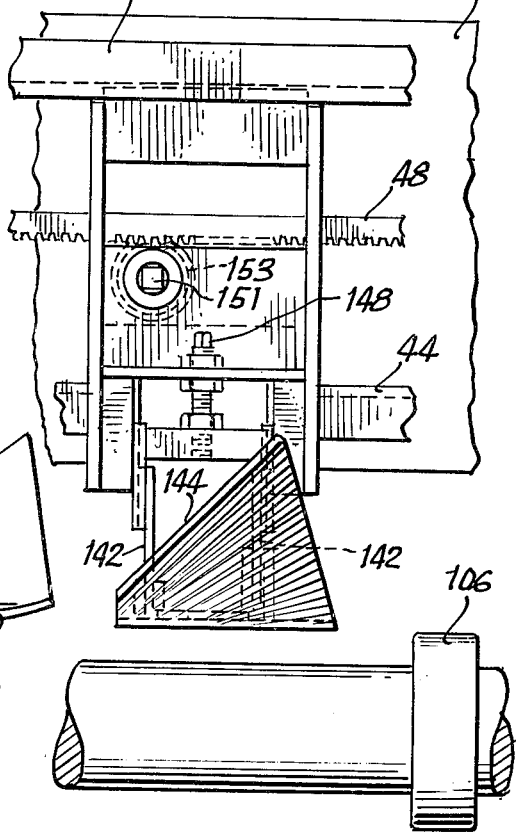
FIG. 5 is a view of the plow assembly illustrated in FIG. 4 taken along the lines 5—5.
Figure 6:
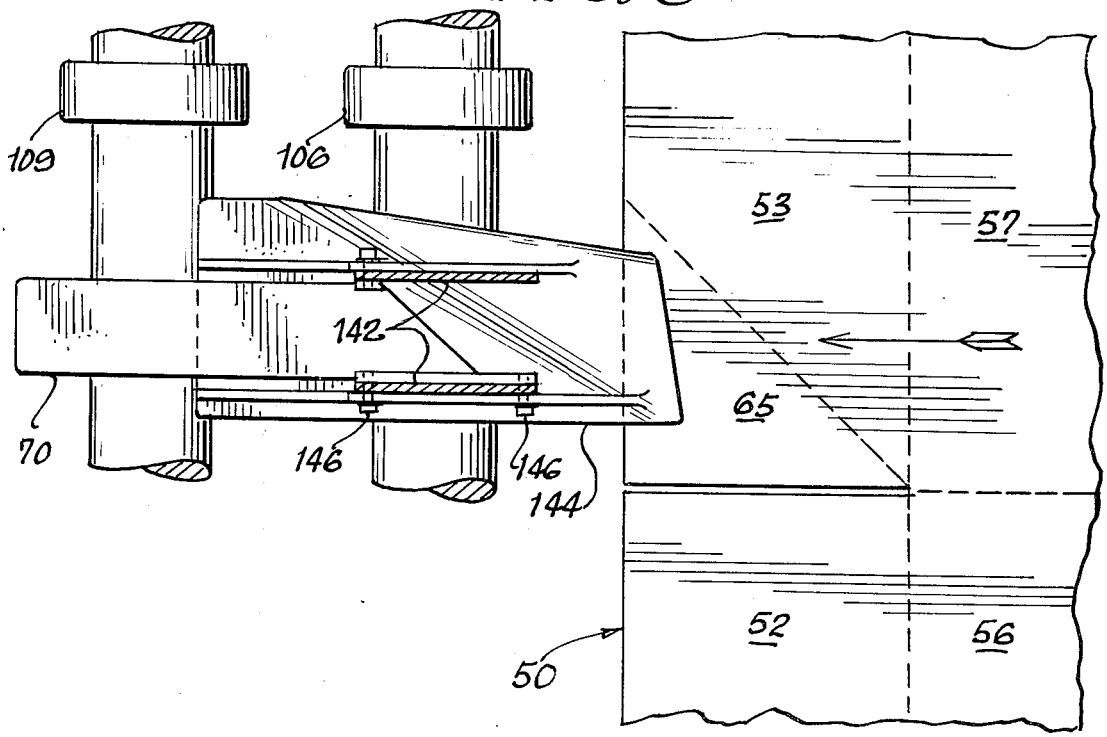
FIG. 6 is a plan view taken along the lines 6—6 of FIG. 4.

Referring now to FIGS. 4–6, the plow assembly is illustrated. In making automatic setup cartons, the plow assembly functions as a second folding means which operates simultaneously in conjunction with the flippers so that as the flippers raise a bottom panel upwardly in order to bend it back onto the side panels, the plows engage a corner of the bottom panel to restrict its motion. Thus, for example in FIG. 2, as the bottom panel 53 is folded over, the triangular portion 65 is folded back and down on top of the folded bottom panel as illustrated by blank 50'. The plow assembly is not mounted to the flipper shaft but is affixed solely to the back plate 82. As illustrated in FIG. 4, the plow assembly is mounted in the clamp bar channels 42 and 44 by means of a housing 140. Attached to the lower section of the housing are mounting brackets 142 to which the plow 144 is attached by screws or bolts 146. As indicated, the plow is an upwardly contoured member having one side thereof raised to engage the triangular portion 65 of a carton bottom flap.

As will be appreciated, the shape of the plow can be varied as necessary for a particular type of box construction and need not be precisely as illustrated in the figures. Further, it will be appreciated that the plow can be used for purposes other than merely restraining a portion of a panel during folding by flippers. For example, a modified plow may be used to produce the folding action which is currently disclosed as being accomplished by the flippers. In such an arrangement the present invention would have two sets of plows spaced along the direction of travel of the cartons such that a first set of plows would cause the bottom flaps to be folded over onto the side flaps in the manner of the present flippers and a second set of plows to accomplish the restraining function. Conversely, a plurality of flippers may be employed whereby the need for plows is obviated.

Referring again to FIGS. 4 and 5, the drawings disclose that the plow assemblies are provided with rack and gear adjusting mechanisms identical to that provided for the small flippers illustrated in FIG. 7. Thus, the plow assembly can be moved laterally across the width of the device to position it anywhere along the rack 149 as desired simply by applying a wrench to the tool receiving portion 151 of the gear 153. The height of the plow 144 above the blank level is maintained by adjustment of bolt 148 utilized to secure the mounting brackets 142 to the housing 140.

As indicated best in FIG. 6, attached rearwardly of the plow is an extension plate 150. This plate functions to maintain the triangular flip which has been reversely folded by the plow in the proper condition until the carton passes to the conveyor means downstream from the present apparatus.

Figure 12:
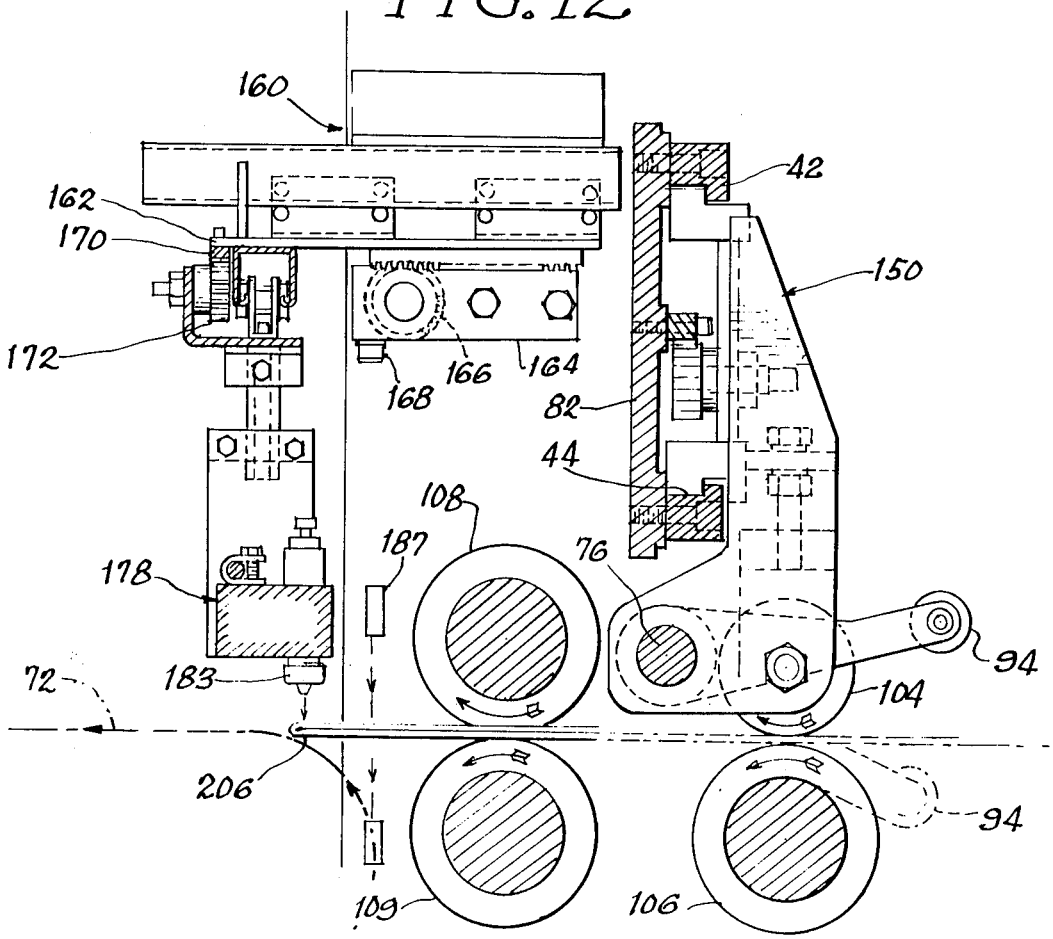
FIG. 12 illustrates an end elevational view of the glue assembly similar to that illustrated in FIG. 11 in conjunction with a flipper assembly according to a second embodiment of the invention.

Referring now to FIG. 12, the large flipper assembly and the adhesive applying unit are illustrated. Referring first to the large flipper assembly, it will be apparent that the construction of the large flipper unit closely parallels the construction described for the small flipper unit in conjunction with FIG. 7. A principal difference is that in place of a pair of plates on either side of the flipper arms, a weldment 150 is employed. This weldment rides in channels formed by the upper and lower clamp bars 42, 44. Similarly, a rack and gear arrangement operated by a wrench or other tool is provided to permit the lateral movement necessary to position the large flipper as desired along the width of the machine feed. Another principal diference between the large flippers and small flipper is the manner of mounting the flipper arms to the weldment. The arms for the large flipper are of unitary construction rather than utilizing the half cylindrical caps for clamping to the flipper shaft. In the large flipper assembly, the flipper arms are mounted to a unitary collar which is secured to the flipper shaft.

Figure 10:
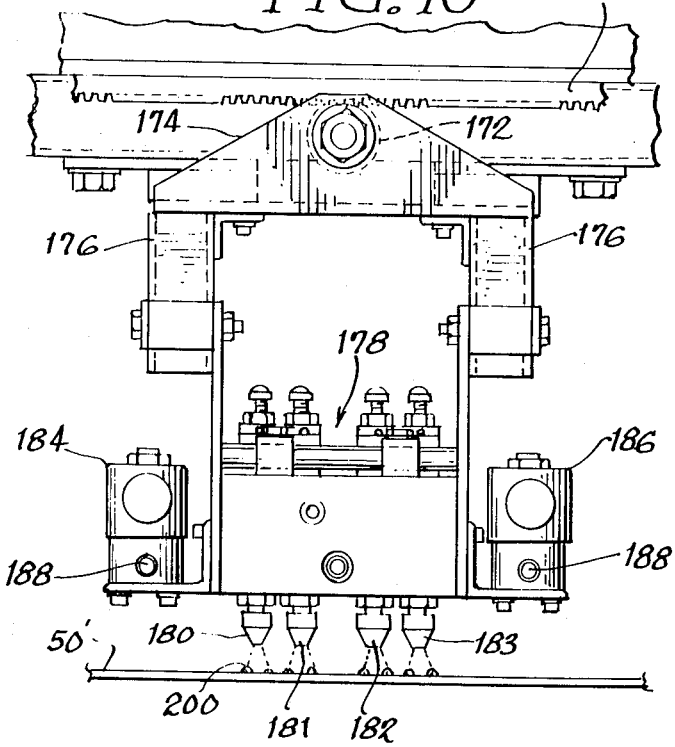
FIG. 10 is a rear elevation of the glue applying assembly of the present invention.
Figure 11:
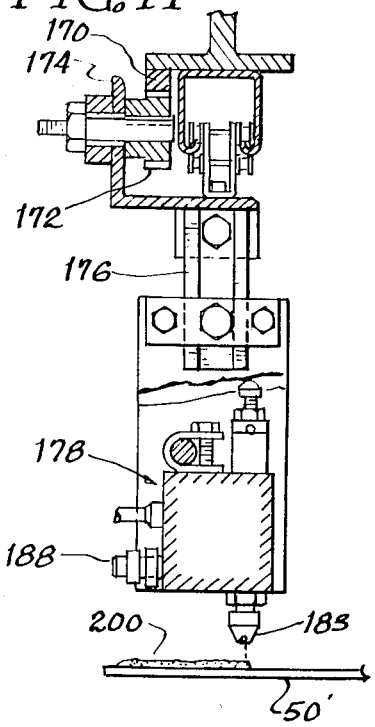
FIG. 11 is an end elevation of the glue assembly illustrated in FIG. 10.

Referring now to FIGS. 10, 11 and 12, the glue applying unit according to the present invention is disclosed. As indicated in FIG. 12, the glueing unit is positioned directly behind the flippers and plows which are mounted to the back plate 82. The glue unit is provided with a rack and gear arrangement for lateral movement similar to the arrangement provided for the plows and flippers. Additionally, a second rack and gear arrangement is provided to permit longitudinal positioning of the glueing unit. The unit is mounted to a mounting angle bracket 160 by means of a T-bar 162 to which the stationary plate 164 is attached. Mounted on the plate 164 is the longitudinal adjusting gear 166. The glueing unit is bolted to the T-bar assembly which is capable of moving longitudinally on the mounting bracket 160. The position of the glueing unit is determined by the position of the rack which is integral with the T-bar 162. As can be appreciated, in order to move the glueing unit longitudinally, a bolt 168 is loosened to permit movement of the glueing unit relative to the mounting bracket 160. The gear 166 is then rotated with a tool along the rack provided on the lower end of the T-bar 162 until the glueing unit is positioned as desired. The bolt 168 is then retightened to provide a steady structural mounting of the positioned glue unit.

As indicated best in FIG. 10, the lateral adjustment of the glueing unit is accomplished in the same manner. The second rack 170 is provided to cooperate with a gear 172 for lateral movement of the assembly. Suspended from the gear plate 174 by a pair of channel brackets 176 is a glue gun 178. The glue gun is of a type commercially available, as for example, manufactured by the Nordsen Company. This gun includes four dispensing valves 180–183 which are air operated; that is, a glue supply provided to the dispensing valves is dispensed when pressurized air is applied to the appropriate valves in a manner well known in the art. The air pressure to the glue gun is controlled by a pair of solenoid operated valves 184 and 186 mounted on a bracket on either side of the glue gun. Solenoid 184 controls the operation of dispensers 180, 181 while solenoid 186 controls the operation of dispensers 182, 183. By appropriately presetting the two solenoids, different glue patterns can be obtained as desired.

The solenoids are actuated by an electrical signal applied thereto which in turn permits the passage of air from the valve portion 188 to the glue gun for dispensing the adhesive. As an example only of the type of patterns whih are desirably utilized, reference is made to FIG. 2 where there is illustrated a typical glue pattern for a carton of the type which automatically sets up. A pair of long glue beads 200 are employed alongside a pair of short glue beads 202. The purpose of the difference is that this pattern precisely fits the triangular flat portion of the bottom panel 53 which is pressed against the bottom panel 52 during the assembly of the carton.

The solenoids 184 and 186 are actuated by an electric eye assembly 187 positioned to detect the presence of a folded carton 206 passing through the rollers 108 and 109. The electric eye is illustrated schematically as being positioned just behind the rollers 108 and 109 and it will be appreciated that they may be mounted to any convenient portion of the structure as desired. In the conventional manner, when the carton 206 breaks the beam between the electric eye source and the receiver, the electrical signal is generated which is applied to the solenoids for actuation thereof.

OPERATION

As thus far described, a device has been disclosed which is capable of receiving a carton blank and processing the blank by folding and applying glue to selected panels thereof to form an automatic setup type carton. Additionally, the device is capable of acting merely as a conveyor to pass carton blanks therethrough which are not of the automatic setup type. Thus, the device can be incorporated into an existing carton assembly line and actuated only when automatic setup cartons are being produced. While the operation of the device is apparent from the preceding portion of the specification, nevertheless a brief operating summary will now be given. A carton blank such as blank 206 (FIG. 12) is passed on a conveyor system to the present invention were a first pair of pull rollers engage the blank. As the carton passes through the first set of compression rollers, the bottom panels which lead the remainder of the blank approach the proximity of the flippers and the plows. If the rocker arm 120 controlling the oscillatory motion of the flipper shaft 76 is positioned so that the cam follower rides the cam, then the flippers will begin an upward movement as the bottom panels engage the flipper rollers. In an alternative, if the rocker arm is raised to lift the follower above the cam surface, the flippers will not engage the cartons but will remain in an elevated position above it, permitting the cartons to pass therebeneath unfolded.

In the operating mode where the flippers are utilized, the flippers move from a position slightly beneath the level of the bottom panels to a position above it, thereby causing the bottom panels of the carton blank to be folded rearwardly onto the side panels which follow it. Simultaneously with the engagement of the bottom panels by the flippers, corner portions of the bottom panels, and in particular the triangular corner portions thereof, engage the lower surface of the plow blade 144. The plow blade restrains movement of this corner portion so that as the bottom flap is folded over, the corner portion is prevented from so doing and ends up in a reverse folded condition on top of the bottom flap of which it is a part. After this dual folding operation is accomplished on the bottom flaps, the carton blank passes beneath two further sets of compression rollers which maintain the carton in its folded condition. Additionally the plow extension member 150 maintains the triangular reversely folded position securely in place.

As the carton continues to move rearwardly, the leading edges thereof interrupts the photocells initiating operation of the glue applying unit. The necessary glue beads are dispensed from the glue gun 178 and applied to the appropriate portions of the bottom flaps 52 and 55 so that when the carton is subsequently folded together, the triangular portion of the flaps 53, 54 will be secured by the adhesive glue beads to the flaps 52, 55. The final folding to complete assembly is accomplished by any convenient means as known in the art for standard box constructions. This is accomplished at an assembly station downstream from the device illustrated herein.

While we have shown and described embodiments of this invention in some detail, it will be understood that this description and illustrations are offered merely by way of example, and that the invention is to be limited in scope only by the appended claims.

We claim:

1. In an apparatus for producing a folded carton from a carton blank a folding device comprising:

a. flipper means reciprocating between a raised position and a lowered position engaging the leading edge of said blank during upward movement for flipping upwardly a portion of said leading edge;

b. means for mounting said flipper means to said apparatus; and c. means for reciprocating said flipper means between said raised and lowered positions.

2. The apparatus of claim 1 wherein said flipper means is carried by said mounting means for securing said flipper means to said apparatus, said apparatus having a member running traversely to the direction of blank travel with upper and lower clamp bars affixed thereto adapted to secure said mounting means therein.

3. The apparatus of claim 1 wherein said means for mounting includes means for permitting lateral positioning of the folding device on said apparatus.

4. The apparatus according to claim 2 wherein said mounting means includes means for permitting positioning of said folding device in said transverse direction, said positioning means including a gear carried on said mounting means, a tool engaging projection extending from said gear, said gear mating with a rack provided on said transverse member whereby rotation of said gear by manual application of a tool to said tool engaging portion causes movement of said folding device along said transverse member.

5. The apparatus of claim 1 wherein said flipper means includes:

a. a roller;

b. a pair of flipper arms to which the roller is mounted at one end thereof; and c. means for attaching the other end of said flipper arms to said means for reciprocating.

6. The apparatus according to claim 5 wherein said means for attaching includes:

a. a first collar segment formed on said other end of said flipper arms; and b. a second collar segment adapted to mate with said first collar segment whereby said collar segments when mated secure said flipper means to said reciprocating means.

7. The apparatus according to claim 5 wherein said means for attaching includes a hollow cylindrical collar formed on said other end of said flipper arms.

8. The apparatus according to claim 6 wherein said collar segments are hollow half cylinders and are mated by securing the segments in cylindrical registry.

9. The apparatus of claim 1 wherein said means for reciprocating said flipper means includes:

a. a flipper shaft mounted for rotation on said apparatus and to which said flipper means are connected for movement therewith; and b. cam means for reciprocally rotating said shaft between a first position wherein said flipper means are below the level of the incoming blanks and a second position above the level of said blanks whereby movement of said flippers between said first and second positions accomplishes folding of portions of said blanks.

10. The apparatus according to claim 9 wherein said cam means includes:

a. a pinion plate attached to one end of said shaft;

b. a rotating cam having a contoured periphery;

c. a cam follower adapted to intimately engage the cam periphery; and d. a connecting linkage joining said pinion plate to said cam follower whereby rotation of said cam causes the cam follower to move in a substantially reciprocating manner thereby causing said flipper shaft to rotate between said first and second positions.

11. The apparatus according to claim 10 further including means for disabling said flipper means to permit carton blanks to pass through said folding device unfolded.

12. The apparatus according to claim 11 wherein said disabling means includes:

a. a rocker arm attached at one end to said cam follower; and b. a double acting piston and cylinder attached to the other end of said rocker arm, whereby extension of said piston from said cylinder prevents said cam follower from contacting said cam and maintains said flippers in said second position above the level of the blanks, while retraction of said piston into said cylinder maintains said cam follower in contact with said cam to produce said reciprocal movement.

13. In an apparatus for producing a folded carton from a carton blank a folding device comprising:

a. flipper means for engaging said blank to cause folding of panels thereof;

b. plow means for simultaneously restraining selected portions of said panels from being folded by said flipper means to thereby simultaneously form a reverse fold of the restrained portion onto the folded panel;

c. means for mounting said flipper and plow means to said apparatus; and d. means for reciprocating said flipper means to fold said blanks.

14. The device of claim 13 wherein said plow means is carried by said mounting means for securing said plow means to said apparatus, said apparatus having a member running traversely to the direction of blank travel with upper and lower clamp bars affixed thereto adapted to secure said mounting means therein.

15. The device of claim 13 wherein said means for mounting includes means for permitting lateral positioning of the folding device on said apparatus.

16. The device according to claim 14 wherein said mounting means includes means for permitting positioning of said folding device in said transverse direction, said positioning means including a gear carried on said mounting means, a tool engaging projection extending from said gear, said gear mating with a rack provided on said transverse member whereby rotation of said gear by manual application of a tool to said tool engaging portion causes movement of said folding device along said transverse member.

17. The device of claim 13 wherein said plow means includes:

a. a plow having a contour adapted to engage a portion of a panel raised by said flipper means for restraining said portion; and b. a pair of brackets attaching said plow to said mounting means at a preselected height above the level at which the blanks pass through said device.

18. The device according to claim 17 wherein said brackets are attached to said mounting means by means for permitting adjustment of the plow height.

19. The device of claim 13 further including means for applying glue to selected portions of said blank.

20. The device according to claim 19 wherein said glue applying means is mounted to said apparatus by means for permitting selectable positioning of said glue applying means.

21. The apparatus according to claim 19 wherein said glue applying means includes:

a. air pressure operated glue dispensers; and b. means for activating said glue dispensers in response to detecting a carton blank at a selected location in said device.

22. The device according to claim 21 wherein said means for actuating includes:

a. an electric eye for detecting the presence of a carton blank in said device and producing an electrical signal in response thereto; and b. solenoid means receiving said electrical signal and applying air pressure to said glue dispensers in response thereto.

23. The device according to claim 20 wherein said glue applying means is independently positionable both in the direction of blank travel and transversely of the blank travel.

24. The device of claim 23 wherein said means for permitting selectable positioning includes for each of said directions:

a gear;

a tool engaging projection extending from said gear; and a rack mating with said gear whereby rotation of said gear by manual application of a tool to said tool engaging portion causes movement of said glueing means.

* * * * *